United States Patent [19]

Shkatov et al.

[11] 4,285,224

[45] Aug. 25, 1981

[54] ELECTRIC PULSE TUBE EXPANDER

[76] Inventors: Alexandr S. Shkatov, ulitsa Olshanskogo, 14, kv. 6; Boris Y. Mazurovsky, ulitsa Teatralnaya, 49/1, kv. 83; Vasily I. Sokolov, ulitsa Sovetskaya, 2, kv. 19; Viktor A. Dmitrichenko, prospekt Mira, 27-b, kv. 143; Sima I. Nazarova, prospekt Mira, 11-b, kv. 71; Ljudmila M. Fedorova, ulitsa Chaikovskogo, 4, kv. 3, all of Nikolaev, U.S.S.R.

[21] Appl. No.: 6,458

[22] Filed: Jan. 25, 1979

[51] Int. Cl.[3] ..... B21D 26/14

[52] U.S. Cl. ..... 72/56; 29/421 M; 72/430; 72/446

[58] Field of Search ..... 72/56, 430, 705, 446, 72/447; 29/421 M, 243.54, 157.3 R

[56] References Cited

U.S. PATENT DOCUMENTS

| | | | |
|---|---|---|---|
| 2,976,907 | 3/1961 | Harvey | 72/56 |
| 3,251,974 | 5/1966 | Seyfried | 72/56 |
| 3,528,092 | 9/1970 | Barkhoudarian | 72/56 |
| 3,849,854 | 11/1974 | Mattioli | 29/421 M |

FOREIGN PATENT DOCUMENTS 352510 6/1972 U.S.S.R. .

*Primary Examiner*—Gene P. Crosby
*Attorney, Agent, or Firm*—Steinberg & Raskin

[57] ABSTRACT

An electric pulse tube expander for a bed with a vertical guide and horizontal guides mounted thereon. An electrode is movably mounted on the vertical guide. Mounted on the horizontal guides are drives for moving the electrode in vertical and horizontal planes. The drives include electric motors, reducers and mechanisms for setting the distance of movement of the electrode. Each of the mechanisms comprises a reducer whose drive gear is kinematically coupled to a lead screw, whereas its driven gear has an arm affixed to, and extending from, its shaft. The arm periodically interacts with a limit switch of a tube expander control system.

5 Claims, 6 Drawing Figures

ELECTRIC PULSE TUBE EXPANDER

FIELD OF THE INVENTION

The present invention relates to plastic working of metals and, more particularly, to electric pulse tube expanders. The invention is applicable to the electric pulse expansion of tubes such as those employed in heat exchangers.

BACKGROUND OF THE INVENTION

The electric pulse expansion of tubes is often carried out with the use of an electric fuse of the type that comprises a casing, a filler and an initiating wire. Such a fuse is inserted into a tube to be expanded. As the electrode approaches the electric fuse, an electric pulse is applied to the initiating wire, and a high-voltage explosion of that wire follows. The resultant shock wave acts through the filler upon the internal surface of the tube which is expanded because of the elastic-plastic deformation.

The aforedescribed process is used to expand tubes of heat exchangers with flat tube plates in which the tubes are arranged at specific distances from each other in horizontal rows. The number of distances between tubes in a row is equal to the number of tubes to be expanded. To expand tubes of such heat exchangers, the electrode has to be movable both in the vertical and horizontal planes.

Apart from expanding tubes of heat exchangers, expanders of the aforedescribed type can be used to expand tubes without tube plates, or tubes accommodated in a die. They may also be used to perform other operations in which deformation of tubes is involved.

A known electric tube expander (cf. USSR Inventor's Certificate No. 352,510, IPC B 21a, 26/10; B 21d, 39/06) comprises a bed with a vertical guide and horizontal guides thereon. An electrode is movably mounted on the vertical guide. Mounted on the horizontal guides are drives for moving the electrode in vertical and horizontal planes. The drives are provided with electrode distance of movement setting mechanisms. Each drive is a pneumatic cylinder incorporating pneumatic arresters which are actuated one after another during motion of the piston of the cylinder. The distance of movement setting mechanisms are adjustable stops installed in each pneumatic cylinder.

The known expander has the disadvantage of not being rapidly readjustable for different tube arrangements. The pneumatic cylinders do not make it possible to accurately position the electrode in relation to the tube, so that part of the energy is wasted to span the gap between the electrode and the electric fuse lead.

Furthermore, it is difficult to adjust the electrode and control system of the known expander to the first tube of another row of tubes of a heat exchanger.

SUMMARY OF THE INVENTION

An object of the invention is to provide an electric pulse tube expander having drives and electrode distance of movement setting mechanisms for accurately positioning the electrode with respect to the tube to be expanded and for facilitating readjustment of the expander to a desired distance and to the first tube of the next row of tubes of a heat exchanger.

The foregoing and other objects of the invention are attained by providing an electric pulse tube expander comprising a bed with a vertical guide and horizontal guides thereon, an electrode movably mounted on the vertical guide, and drives for moving the electrode in vertical and horizontal planes. The drives are mounted on the horizontal guides. The drive for moving the electrode in a vertical plane is movable on the horizontal guides. Each of the drives includes a mechanism for setting the distance of movement of the electrode. The mechanism is connected to an expander control system. In accordance with the invention, each of the drives is a screw pair and each electrode distance of movement setting mechanism is a reducer having a drive gear kinematically coupled to the screw pair and a driven gear with an arm affixed to, and projecting from, its shaft. The arm operably interacts with a limit switch of the expander control system.

The electric pulse tube expander of the invention positions the electrode with improved accuracy with respect to the tube. This results in a reduction of the amount of power required to pierce the gap between the electrode and the electric fuse lead.

One gear of each of the reducers is preferably interchangeable and has a number of teeth corresponding to the distance of movement of the electrode.

This facilitates the readjustment of the expander to a desired distance. Each of the reducers may include at least one intermediate gear meshed with the drive gear. Both gears may be accommodated in a housing rotatable around the axis of the drive gear and coupled to an electromagnet connected to the control system of the expander for controlling the angular position of the housing. The housing with the intermediate and drive gears is preferably provided with a spring to return it to the initial position. The aforedescribed arrangement facilitates the readjustment of the electrode and control system to the first tube of the next row of tubes to be expanded. The adjustment involves no manual operations and thus provides a higher production rate.

BRIEF DESCRIPTION OF THE DRAWINGS

Other objects and advantages of the present invention will become more apparent from the following detailed description of preferred embodiments thereof, taken in conjunction with accompanying drawings, wherein.

DETAILED DESCRIPTION OF THE INVENTION

Figure 1:
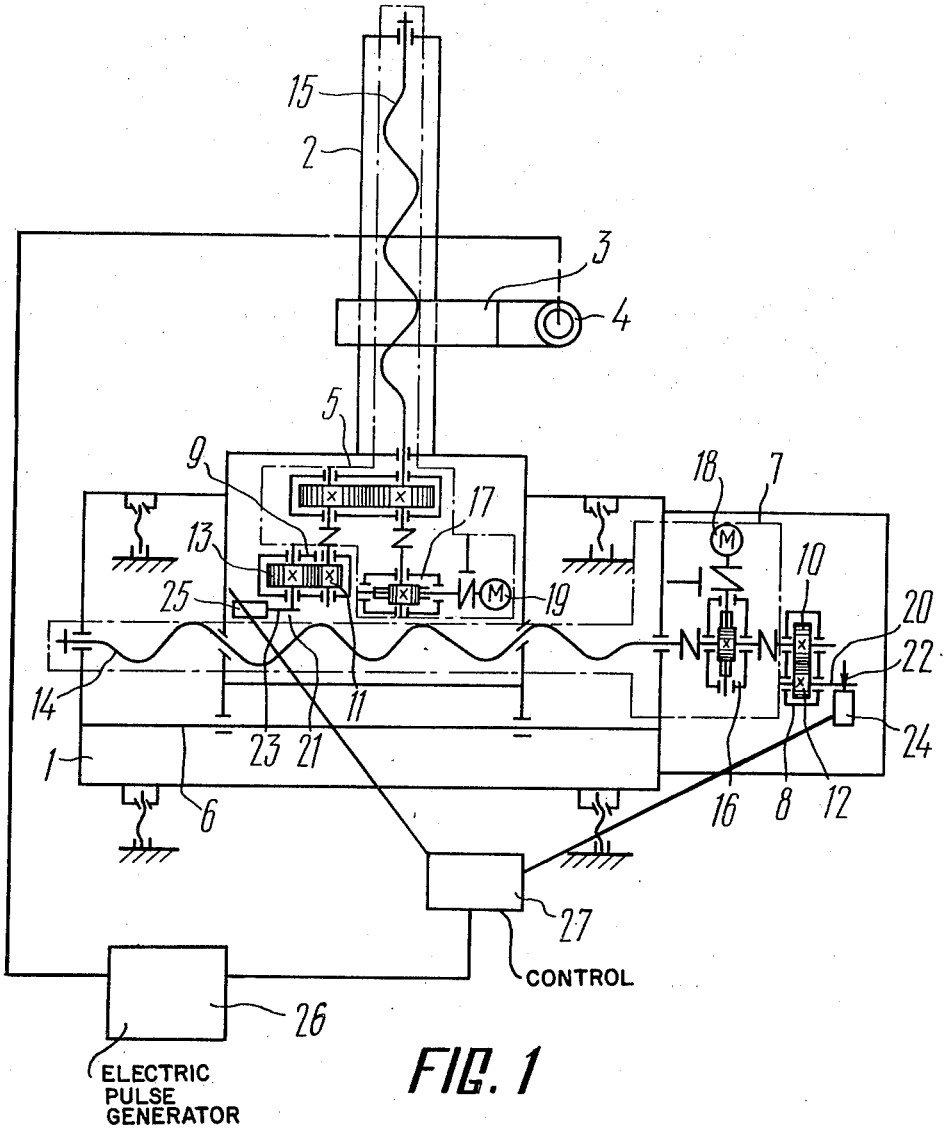
FIG. 1 is a functional diagram of an embodiment of the electric pulse tube expander of the invention.

The electric pulse tube expander of the invention comprises a bed 1 with a vertical guide 2 mounted thereon. Mounted on the vertical guide 2 is a yoke 3 with an electrode 4 movable in a vertical plane by a drive 5. The bed 1 also has horizontal guides 6 mounted thereon or integrally formed therewith. The drive 5 and a drive 7 intended to move the electrode 4 in a horizontal plane are mounted on the horizontal guides 6. The drive 5 is movable on the horizongal guides 6, which may be longitudinal projections, for example, by the drive 7. The drives 5 and 7 are provided with mechanisms 8 and 9, respectively, intended to set the distance of movement of the electrode 4. Each of the mechanisms 8 and 9 comprises a reducer with drive gears 10 and 11 and driven gears 12 and 13.

The drive gears 10 and 11 are kinematically coupled to the drive 7 for driving the electrode 4 in a vertical plane and the drive 5 for driving the electrode 4 in a horizontal plane. Each of the drives is a screw pair, because they include lead screws 14 and 15 coupled to reducers 16 and 17 and electric motors 18 and 19. Arms 22 and 23 are affixed to, and project from, shafts 20 and 21, respectively, of the driven gears 12 and 13, respectively. The arms 22 and 23 operably interact with limit switches 24 and 25, respectively an electric pulse generator 26 discharges via the limit switches 24 and 25 in instructions received from a control system 27 of the tube expander. The arms 22 and 23 interact with the limit switches 24 and 25, respectively, in a known manner. Various types of interaction are possible, depending upon the particular type of limit switch. Thus, if the limit switch is of contact type, for example, the arm reacts with a projection of the switch to close its contacts, and if the limit switch is contactless, the switch reacts when the arm enters a slot thereof.

In order to speed up the readjustments of the mechanisms which adjust the distance of movement of the electrode 4 to that of the tube plate when expanding tubes of heat exchangers featuring different tube arrangements, it is expedient that the drive gears 10 and 11 or driven gears 12 and 13 of the mechanisms 8 and 9, respectively, be interchangeable. The number of teeth of the interchangeable gears is dependent upon the distance of movement of the electrode 4 and is selected so that the arms 22 and 23 rotate only through an angle of 360°, regardless of the distance of movement of said electrode 4.

The readjustment of the electrode and the control system of the expander to the first tube of the next row of tubes is carried out with the aid of an auxiliary unit (FIG. 2) which comprises the reducers 8 and 9 provided with intermediate gears 28 and 29, respectively, incorporated in the drives 5 and 7, respectively. The number of teeth of the intermediate gears 28 and 29 predetermines the distance of movement of the electrode, since these gears are kinematically coupled to the lead screws 14 and 15, respectively. A specific number of revolutions of the lead screws 14 and 15 results in a predetermined distance of movement of the electrode, which in turn corresponds to a rotation of the arms 22 and 23, respectively, through an angle of 360°. The number of teeth of the intermediate gear 28 or 29 is thus inversely proportional to the distance of movement of the electrode.

Figure 2:
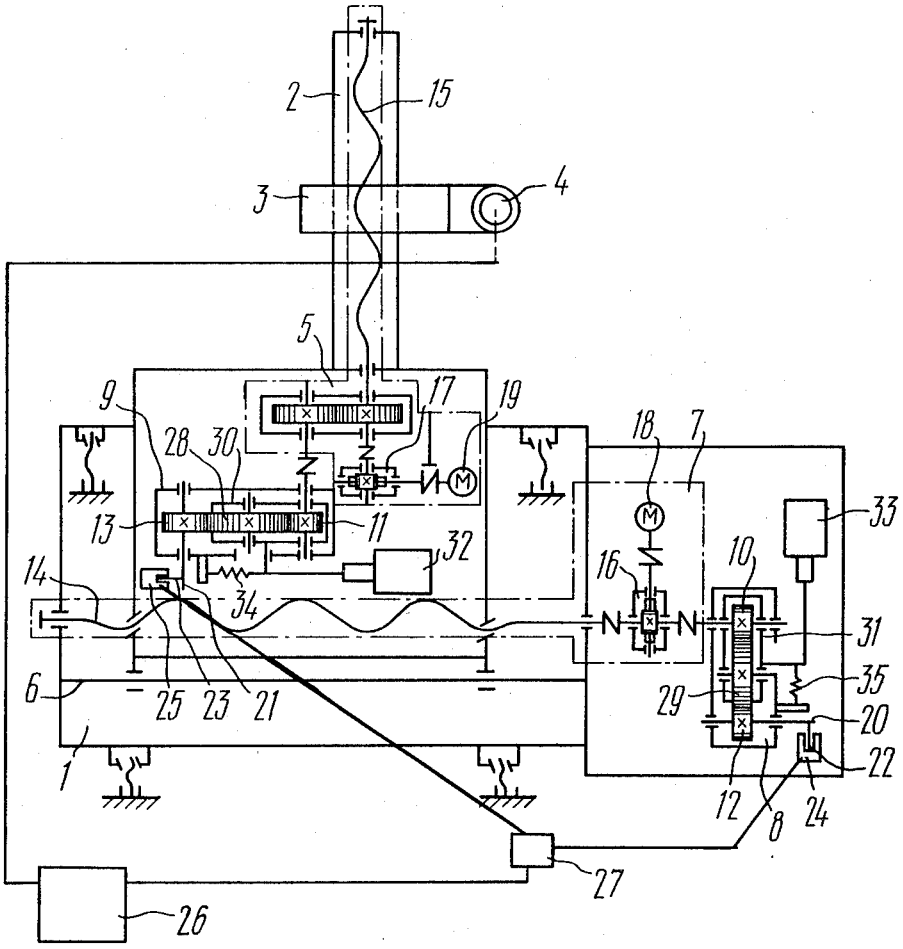
FIG. 2 is a functional diagram of another embodiment of the electric pulse tube expander in accordance with the invention, featuring an auxiliary unit for the adjustment of the electrode and control system to the first tube of the next row of tubes.

For the sake of simplicity, FIG. 2 shows only one intermediate gear in each reducer, alghough each reducer may have two or three intermediate gears, depending on the number of teeth on the driven (interchangeable) gears 12 and 13. The intermediate gears are accommodated in common housings 30 and 31, respectively, with the drive gears 11 and 10, respectively. The housings 30 and 31 are rotatable about the axes of their respective drive gears 11 and 10 by electromagnets 32 and 33, respectively. The electromagnets 32 ad 33 are electrically connected to the control system 27. The intermediate gears 28 and 29 are meshed with the drive gears 11 and 10 and the driven gears 13 and 12, respectively.

Mounted on the housings of the reducers 8 and 9 are springs 35 and 34, respectively, intended to return the housings 31 and 30 to their initial positions after the electromagnets 33 and 32 are deenergized. The housings 30 and 31 are rotated to disengage the gears during positioning of the electrode. This permits the electrode to be located in front of the first electric fuse to be activated or the first tube, and also permits the installation of the arms 22 and 23 to their initial positions in response to command of the control system, without the need for manual resetting, so that an operator need not enter the work zone.

Figure 3:
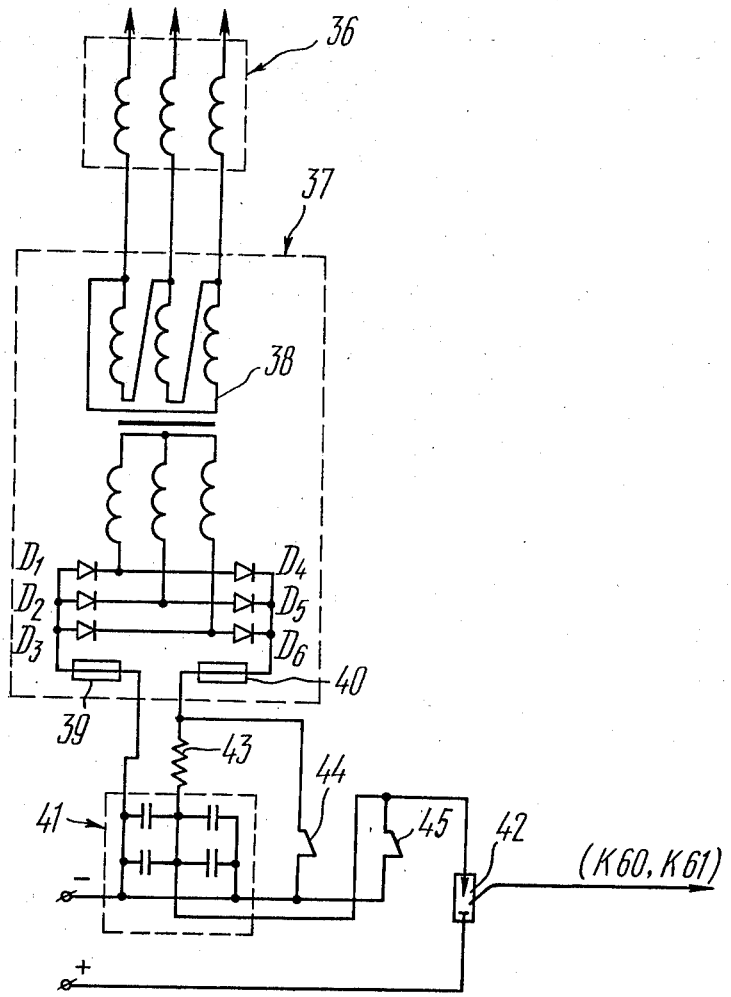
FIG. 3 is a circuit diagram of an embodiment of the electric pulse generator of the electric pulse tube expander of the invention.

The electric pulse generator 26 (FIG. 3) incorporates an inductive reactance 36 for reducing current fluctuations. A high voltage rectifier 37 at the output of the reactance 36 comprises a step-up transformer 38, a rectifier having diodes $D_1$ through $D_6$, and fuses 39 and 40. A bank 41 of capacitors is connected to the output of the high voltage rectifier 37. The bank 41 of capacitors stores power to be transmitted to the electrode 4. The inductive reactance 36 reduces current fluctuations during charging of the bank 41 of capacitors and may comprise any suitable inductive reactance such as, for example, a copper wire coil wound on a steel core. A discharge unit 42 is connected to the output of the bank 41 of capacitors for connecting said capacitors to the electrode 4. The discharge unit 42 comprises two main electrodes and one auxiliary electrode accommodated in a metal housing (not shown in the FIGS.)

An electric discharge is produced between the main electrodes. The auxiliary electrode ionizes the interelectrode gap. Two more discharge circuits are connected to the output of the bank 41 of capacitors. The first discharge circuit consists of a discharge resistor 43, an electric blocking element 44 and the bank 41 of capacitors. The second discharge circuit consists of an electric blocking element 45 and the bank 41 of capacitors. The electric blocking elements 44 and 45 may be of different types such as, for example, that utilizing insulated rods with current conducting contacts or movable rods with contacts.

The discharge resistor 43 and electric blocking elements 44 and 45 remove residual voltage from the bank 41 of capacitors after a discharge.

The control system 27 comprises an electric drive (FIG. 4), an electric drive control unit (FIG. 5) and a pulse counter (FIG. 6) for counting pulses in a number equal to that of the expanded tubes.

Figure 4:
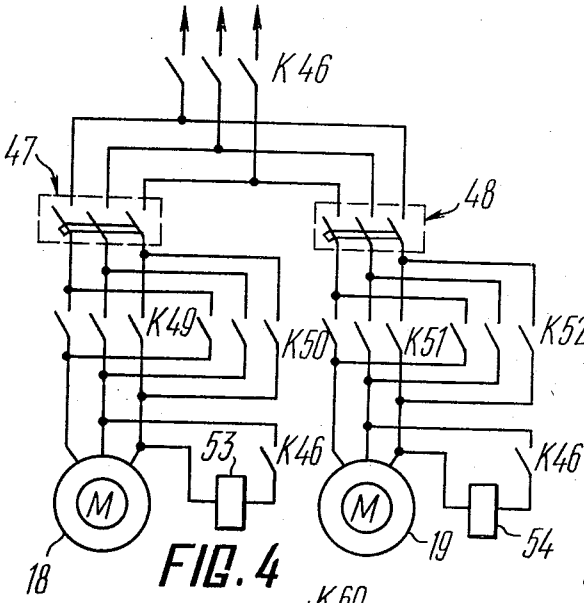
FIG. 4 is a circuit diagram of an embodiment drive unit of the tube expander of the invention.

FIG. 4 is a circuit diagram of the electric drive. Contacts K46 of a switching means 46 are connected to the input of the drive circuit. Circuit breakers 47 and 48 are connected to the switching means 46 for protecting the electric motors 18 and 19 from overheating and short-circuiting. Contacts K49 through K52 of reversible magnetic contactors 49 through 52 are connected in series with the circuit breakers 47 and 48 for feeding a supply voltage to the stator windings of the electric motors 18 and 19. After the electric motors 18 and 19 are disconnected from the supply main, they must be rapidly braked. This is accomplished by mechanical braking means (not shown in the FIGS.) actuated by electromagnets 53 and 54. The windings of the electromagnets 53 and 54 are connected in parallel with respective inputs of the motors 18 and 19. One input of the electromagnets 53 and 54 is connected via a contact of the magnetic contactor K46.

Figure 5:
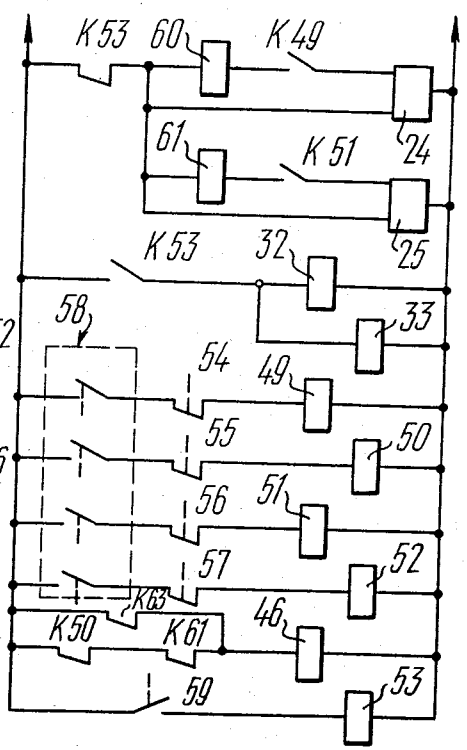
FIG. 5 is a circuit diagram of an embodiment electric drive control circuit of the tube expander of the invention.

FIG. 5 shows the electric drive control unit of the pulse tube expander of the invention. The drive control unit includes the contactless limit switches 24 and 25 for actuating the electric pulse generator 27 when the driven gears rotate through an angle of 360°. The electric drive control unit further includes the electromagnets 32 and 33 for cutting the kinematic chain of the mechanisms 8 and 9 when the electrode 4 is brought opposite a tube to be expanded. The circuitry also includes coils or windings of the switching means 46 and magnetically-controlled contacts 49 through 52.

The electromagnets 32 and 33 are connected to the supply main by means of a contact K53 of the electromagnet or relay 53 which also deenergizes the contactless limit switches 24 and 25 via a break contact K53. Contacts 54 through 57 of the limit switches 24 and 25 are connected in series with the coils or windings of the magnetically-controlled contacts 49 through 52 and disconnect them whenever the electrode 4 reaches an extreme position in the horizontal or vertical planes.

A switch 58 is intended to select the direction of movement of the electrode 4. The electrode may move up and down, left and right. For this purpose, the contacts of the switch 58 are connected in series with the contacts 54 through 57 of the limit switches 24 and 25 and the coils or windings of the magnetically-controlled contacts 49 through 52.

A switch 59 is connects the electromagnet or intermediate relay 53 to the supply main at the instant the electrode 4 is found opposite a tube to be expanded. Relays 60 and 61 are output relays of the limit switches 24 and 25, respectively. The coils or windings of the relays 60 and 61 are connected to the outputs of the switches 24 and 25 through the contacts of the magnetically-controlled contacts K49 and K51.

Figure 6:
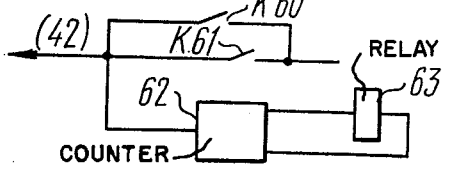
FIG. 6 is a circuit diagram of one embodiment of the pulse counter of the tube expander of the invention adjustable for a desired number of tubes.

FIG. 6 shows a pulse counter 62 for counting pulses of a number equal to that of tubes in one row.

The counter 62 counts the number of expanded tubes and gives an instruction whenever a preset number of tubes in a row are expanded. The input of the counter 62 is connected to the contacts of the relays 60 and 61, which are also connected to the auxiliary electrode of the discharge device 42. The output of the counter 62 is connected to a relay 63 whose break contact cuts off the switching means 46 (FIG. 5).

The electric pulse tube expander of the invention operates as follows.

Prior to the start of operation, voltage is applied to the blocking elements 44 and 45 which unblock the bank 41 of capacitors. Voltage is then applied to the inductive reactance 36 and the high voltage rectifier 37. The rectified voltage of the rectifier 37 is applied to the bank 41 of capacitors so that said capacitors are charged. The contacts K46 of the switching means 46 are closed so that the power circuits of this electromotors 18 and 19 are ready for operation. The direction of movement of the electrode 4 is selected by the switch 58, and one of the motors 18 and 19 is put into action. The distance of movement of the electrode 4 is set by the interchangeable drive gears 10 and 11 and the driven gears 12 and 13.

The torque of the motors 18 and 19 is transmitted through the reducers 16 and 17 to the drive gears 10 and 11 of the mechanisms 8 and 9, respectively, and to the lead screws 14 and 15 which move the drive 5 on the horizontal guides 6 and the yoke 3 with the electrode 4 on the vertical guide 2. As the electrode 4 is set in motion, the arms 22 and 23 affixed to the shafts 20 and 21, respectively, of the driven gears 12 and 13, respectively, make one revolution and act on the limit switches 24 and 25, whereby the relays 60 and 61 are actuated or energized. At such instant, the electrode 4 is opposite the tube to be expanded. As the relay 60 or 61 is actuated, voltage is applied to the auxiliary electrode of the discharge device 42. The bank 41 of capacitors discharges into the electrode 4. The number of tubes or distances, covered by the electrode 4 per working cycle is set via the counter 62. After a preset number of tubes are expanded, the relay 63 is energized or actuated, and the winding of the switching means 46 is deenergized. After the discharge, the electrode 4 is found opposite the last of the tubes expanded during the working cycle.

After the generator 26 is disconnected from the supply main, the electric blocking element 4, connects the bank 41 of capacitors to the discharge resistor 43. The bank 41 of capacitors discharges through the circuit composed of the discharge resistor 43, the electric blocking element 44 and said bank of capacitors. After the removal of residual voltage, the bank 41 of capacitors is short-circuited by the electric blocking element 45.

An alternative embodiment of the tube expander of the invention, featuring an auxiliary unit, operates as follows (FIG. 2).

After a tube of a row of tubes has been expanded, the drives 5 and 7 are cut off, and the electrode 4 stops opposite the last tube. As this occurs, the arms 22 and 23 assume specific positions in the limit switches 24 and 25.

The switch 59 actuates the relay 53. The closed contact of the relay 53 energizes the electromagnets 32 and 33, which rotate the housings 30 and 31 about the axes of the drive gears 10 and 11, so that the intermediate gears are disengaged from the driven gears 12 and 13 and the kinematic chain between said drive gears and said driven gears is broken. The electrode 4 is then moved to the first tube of the next row. As soon as the electrode 4 is positioned opposite that tube, the switch 59 disconnects the relay 53 and deenergizes the electromagnets 32 and 33. The springs 34 and 35 return the housings 30 and 31 to their initial positions, whereby the intermediate gears 28 and 29 are meshed with the driven gears 12 and 13. Then, when the kinematic coupling of the elements that set the distance of the reducers 8 and 9 is again functioning, the arms 22 and 23 are in specific positions in the limit switches 24 and 25, the electrode 4 is opposite the next tube, the control system is adjusted for the first tube, and the tube expander is ready to work a row of tubes automatically. When the row of tubes is finished, the working cycle is repeated.

Thus, the electric pulse tube expander of the invention eliminates losses of power for piercing the air gap. This is due to the accurate positioning of the electrode with respect to the tube to be expanded. The efficiency of the tube expander is greatly improved.

The use of interchangeable gears in the electrode distance of movement setting mechanisms results in a faster and simpler readjustment of these mechanisms and thus helps to increase the production rate.

The control of the kinematic chain of the expander through the use of interchangeable gears with rotatable housings in the electrode distance of movment setting mechanisms facilitates the adjustment of the electrode and control system to the first tube of the next row, which permits dispensing with manual adjustment operations and thus raises the production rate.

What is claimed is:

1. An electric pulse tube expander for expanding a tube, said tube expander comprising a bed;

horizontal guides mounted on said bed;

carriage means guided by said horizontal guides;

a vertical guide mounted on said carriage means;

an electrode for applying a pulse to a tube to be expanded, said electrode being movable in vertical and horizontal planes, and being mounted on said vertical guide so that it is movable in a vertical plane on said vertical guide;

a first drive mounted on said bed for moving said electrode in a horizontal plane, said first drive including a first electric motor for producing a torque to move said electrode in a horizontal plane, a first reducer kinematically coupled to said first motor, said first reducer having an output shaft, and a first mechanism for setting the distance of movement of said electrode, said first mechanism being connected to said output shaft of said first reducer and having a first drive shaft operatively coupled to said first reducer, a first drive gear mounted on said first drive shaft, a first driven shaft, a first driven gear mounted on said first driven shaft and having teeth in a number corresponding to a given distance of movement of said electrode, said first drive and driven gear being in coupling relation with each other, a first arm affixed to and projecting from said first driven shaft, a first limit switch operably interacting with said first arm, a first lead screw mounted on said bed and kinematically coupled to the output shaft of said first reducer for moving said electrode in a horizontal plane, said first lead screw moving said vertical guide with said electrode in a horizontal plane;

a second drive mounted on said horizontal guides for moving said electrode in a vertical plane, said second drive including a second electric motor for producing a torque to move said electrode in said vertical plane, a second reducer kinematically coupled to said second motor, said second reducer having an output shaft, and a second mechanism for setting the distance of movement of said electrode, said second mechanism being operatively coupled to said output shaft of said second reducer and having a second drive shaft operatively coupled to said second reducer, a second drive gear mounted on said second drive shaft, a second driven shaft, a second driven gear mounted on said second driven shaft and having teeth in a number corresponding to the distance of movement of said electrode, said second drive and driven gear being in coupling relation with each other, a second arm affixed to and projecting from said second driven shaft, a second limit switch operably interacting with said second arm, a second lead screw kinematically coupled to the output shaft of said second reducer for moving said electrode in a vertical plane, said second lead screw moving said electrode in a vertical plane on said vertical guide;

a pulse generator electrically connected to said electrode for producing an electric current pulse for a tube expansion operation; and control means electrically connected to said pulse generator and to said first and second drives for moving said electrode in horizontal and vertical planes.

2. An electric pulse tube expander as claimed in claim 1, wherein each of said first and second mechanisms for setting the distance of movement of said electrode in horizontal and vertical planes further has an intermediate gear meshed with the drive gear thereof, a housing accommodating said intermediate gear and said drive gear and rotatable about the axis of said drive gear, and an electromagnet electrically connected to said control means for controlling the angular position of said housing.

3. An electric pulse tube expander as claimed in claim 1, wherein said pulse generator includes an inductive reactance, a step-up transformer electrically connected in series with said reactance, a high voltage rectifier electrically connected to said step-up transformer, said rectifier having first and second terminals, a bank of capacitors, a first fuse electrically connecting the first terminal of said rectifier to said bank of capacitors, a second fuse, a resistor electrically connected in series with said second fuse between the second terminal of said rectifier and said bank of capacitors, a first electric blocking element electrically connected in series with said resistor and said bank of capacitors, a second electric blocking element electrically connected in parallel with said bank of capacitors, a discharge device electrically connected in series with said bank of capacitors for applying an electric discharge to said electrode.

4. An electric pulse tube expander as claimed in claim 1, further comprising a source of electrical energy, and wherein said first and second electric motors are kinematically coupled to said first and second lead screws, respectively, for moving said electrode in horizontal and vertical planes and for producing a torque for said first and second mechanisms and wherein said control means includes an electric drive unit having first and second electromagnets electrically connected in parallel with said first and second electric motors, respectively, first and second groups of reversible magnetically-controlled contacts electrically connected in parallel with said first and second electric motors, respectively, first and second circuit breakers electrically connected in series with said first and second groups of reversible magnetically-controlled contacts for protecting said first and second electric motors from overloads, and first and second switching means electrically connected in parallel with said first and second circuits breakers, respectively, and a control system having said first and second limit switches electrically connected to said source of electrical energy, first and second relays electrically connected in parallel with said first and second limit switches, respectively, first and second electromagnets electrically connected to said source of electrical energy for breaking the kinematic chain of said first and second mechanisms, each of said first and second groups of magnetically-controlled contacts controlled in operation by coils electrically connected to said source of electrical energy, said first and second limit switches having contacts electrically connected for switching off said magnetically-controlled contacts when said electrode is in an extreme position, means electrically connected in series with the contacts of said limit switches for selecting the direction of movement of said electrode a pulse counter for counting pulses in a number corresponding to the number of expanded tubes, and a relay electrically connected in parallel with said pulse counter, said relay contacts being electrically connected in series with said pulse counter.

5. An electric pulse tube expander as claimed in claim 2, wherein each of said first and second mechanisms further comprises a spring having a first end affixed to a housing thereof and a spaced opposite second end affixed to the corresponding electromagnet for returning said housing accommodating said intermediate gear to an initial position.

* * * * *